US005361987A

United States Patent [19]

Matheussen et al.

[11] Patent Number: 5,361,987

[45] Date of Patent: Nov. 8, 1994

[54] STRAW

[76] Inventors: Koen Matheussen, Pas 198; Peter Hendrickx, Retiesweg 39; Koen Belmans, Possonsdries 7; Luc de Bal, Dr. Van de Perrestraat 46, all of 2440 Geel,

[21] Appl. No.: 118,130

[22] Filed: Sep. 8, 1993

[30] Foreign Application Priority Data

Sep. 11, 1992 [BE] Belgium ..... 09200799

[51] Int. Cl.[5] ..... A47G 21/18

[52] U.S. Cl. ..... 239/33; 40/406; 215/1 A; D7/300.2

[58] Field of Search ..... 239/33; 446/200, 202; 215/1 A; 220/705; 40/406; D7/300.2

[56] References Cited

U.S. PATENT DOCUMENTS

| | | | |
|---|---|---|---|
| D. 225,486 | 12/1972 | Bart | D7/300.2 |
| D. 294,671 | 3/1988 | Koziol | D7/300.2 |
| 2,370,931 | 3/1945 | Bogin et al. . | |
| 2,544,594 | 3/1951 | Goldfarb . | |
| 2,619,770 | 12/1952 | Dinhofer | 239/33 |
| 3,879,885 | 4/1975 | Fabricant | 446/202 |
| 4,211,024 | 7/1980 | Nickell | 40/406 |
| 4,252,273 | 2/1981 | Karterman | 239/33 |
| 4,726,518 | 2/1988 | Martina et al. | 239/33 |
| 4,733,785 | 3/1988 | Turner, Jr. et al. | 239/33 |
| 4,921,713 | 5/1990 | Fowler . | |

FOREIGN PATENT DOCUMENTS

| | | | |
|---|---|---|---|
| 3407733 | 9/1985 | Germany | 239/33 |
| 0015572 | of 1891 | United Kingdom | 220/705 |

*Primary Examiner*—Karen B. Merritt
*Attorney, Agent, or Firm*—Bacon & Thomas

[57] ABSTRACT

A straw is formed by a hollow upper part, a hollow lower part and an enlargement provided between the hollow upper and lower parts. The lower part extends into the enlargement to define a space therein between the hollow lower part and the enlargement. The hollow upper part opens into the enlargement above this space. With this construction, after the straw has been used to draw a beverage from a container, the space in the enlargement will remain filled with a portion of the beverage.

5 Claims, 2 Drawing Sheets

Fig. 1
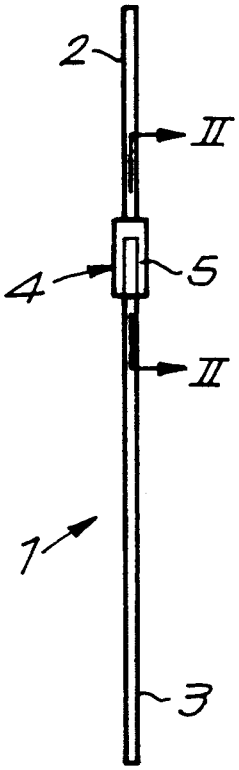
Fig. 2
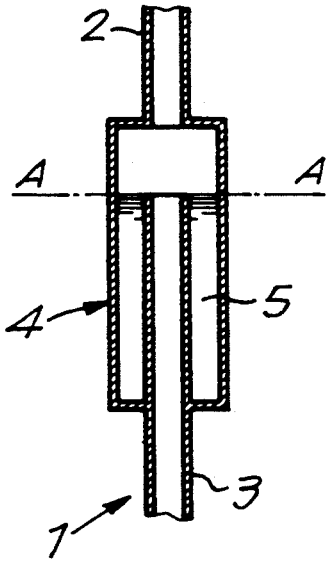
Fig. 3
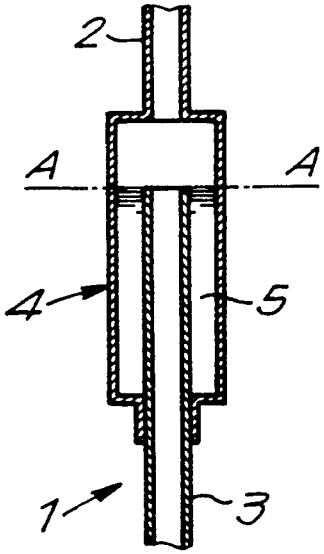
Fig. 4
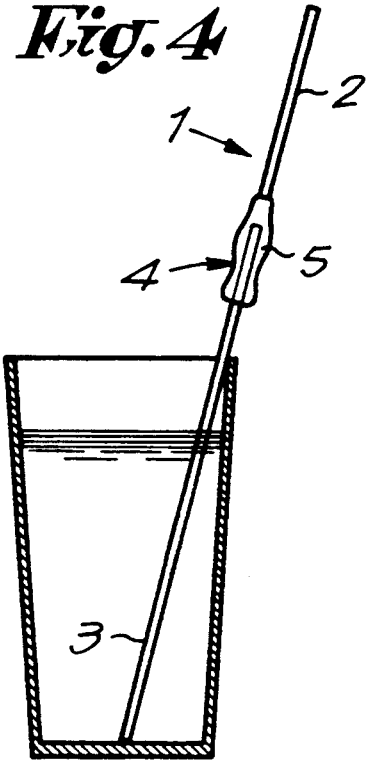
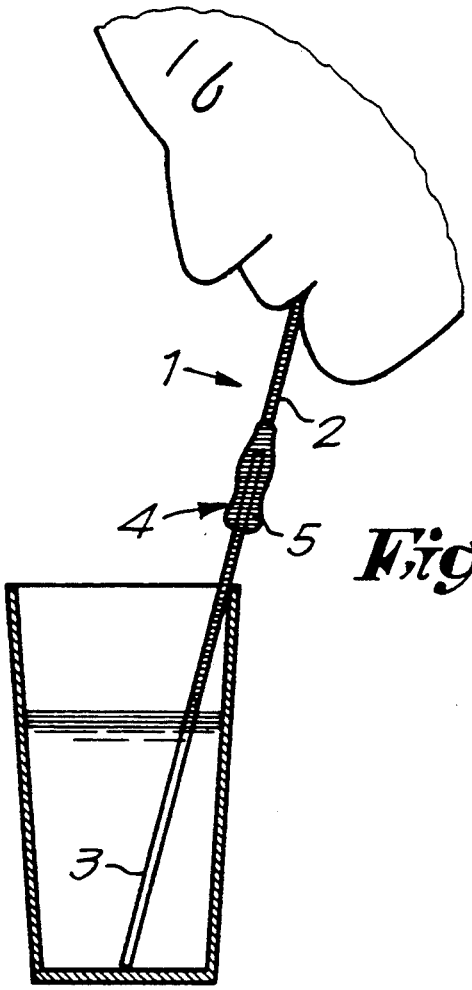
Fig. 5

STRAW

BACKGROUND OF THE INVENTION

The present invention relates to a straw, more specifically to an instrument as it is generally used to consume beverages, both from a glass and from a bottle, can or the like.

Such straw is until now always limited to a simple tube, eventually provided with a bendable part, through which the liquid is sucked up.

SUMMARY OF THE INVENTION

The present invention, however, relates to a straw which is provided with an additional element in the form of an enlargement which can deliver a message, be a pure ornament, have an advertising purpose or the like.

More specifically, the present invention relates to such straw in which said enlargement is manufactured in such a way that the latter, after the straw has been used once, has been filled up to a certain height and stays filled with the sucked up beverage so that, if this beverage is colored, such as it is the case with lemonades, the enlargement of the straw presents a certain aspect.

In a special embodiment, the enlargement will have the form of a generally known product, for example the form of a soft drink bottle or the like, whereby this bottle is empty before using the straw and whereby this bottle presents the special characteristic that, after the straw has been used once, it is filled with the concerned beverage, and this up to a height up to where the beverage bottle or the like is normally filled.

To this end, the straw according to the invention which presents these and other characteristics, mainly consists of a hollow upper part and a hollow lower part between which an enlargement is provided, whereby the lower part continues into the enlargement.

BRIEF DESCRIPTION OF THE DRAWINGS

In order to better illustrate the characteristics of the invention, some preferred embodiments of such a straw are described hereafter, as examples without any limiting character whatsoever, reference being made to the accompanying drawings, in which:

FIG. 1 represents an outside view of a straw according to the invention;

FIG. 2 represents a cross-section according to line II—II in FIG. 1;

FIG. 3 represents a cross-section similar to that of FIG. 2, but for a different embodiment;

FIG. 4 represents a straw according to the invention, inserted in a glass of beverage before the first use of the straw;

FIG. 5 represents a view similar to that of FIG. 4, during the sucking up of liquid;

DETAILED DESCRIPTION OF THE INVENTION

Figure 6:
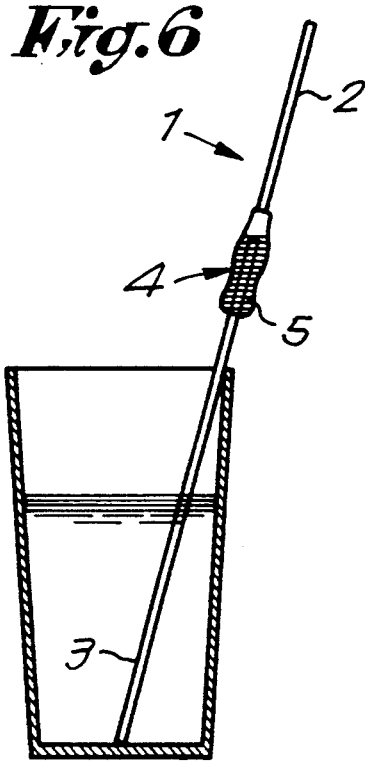
FIG. 6 represents a view similar to that of FIGS. 4 and 5, but after the sucking up of liquid has stopped.

In FIGS. 1 and 2, a straw 1 according to the invention is represented, which mainly consists of a hollow upper part 2 and a hollow lower part 3, whereby the upper part 2 at its bottom connects normally to an enlargement 4, while the lower part 3 at its upper end continues into the enlargement 4, up to a small distance from the part 2.

A straw 1 according to the invention can be realized in any material. However, synthetic material will be mostly used.

While in FIGS. 1 and 2 the straw is realized in one part, it can, as represented in FIG. 3, also consist of two main parts, namely the upper part 2 which forms a whole with the enlargement 4, and the lower part 3 which is applied in the enlargement 4 and connected in a suitable way to this enlargement, for example by means of glueing.

When the part 3 of a thus formed straw is plunged in a liquid and consecutively liquid is sucked up by sucking in a known way at the free end of the part 2 of such a straw, the beverage in which the straw has been placed will be consumed in a normal way as this is the case with a known straw.

However, when the suction on the straw is interrupted, the liquid or beverage which is present in the straw will flow back, whereby an amount of liquid will remain in the enlargement, which liquid will fill the space 5, in other words the space formed between the bottom of the enlargement 4 and the upper end of the lower part 3 of the straw, more specifically the space formed between the bottom of the enlargement 4 and the line A—A.

This characteristic is clearly represented in FIGS. 4 to 6, where the straw is represented before liquid has been sucked up; during the sucking up of liquid and after liquid has been sucked up and the sucking up has been stopped.

In these FIGS. 4 to 6, the form of a bottle has been chosen for the form of the enlargement 4, so that this bottle is as it were empty in the first instance, is completely filled during the sucking up of beverage, and stays filled up to a certain height after the sucking up has stopped.

It is thus obtained that in this way for example a form of a bottle can be chosen which corresponds with the form of the bottle in which the concerned beverage is normally marketed, so that not only a very attractive form of a straw is obtained, but that this straw will, besides an attractive function and eventually a game-function, also have an advertising function.

Figure 7:
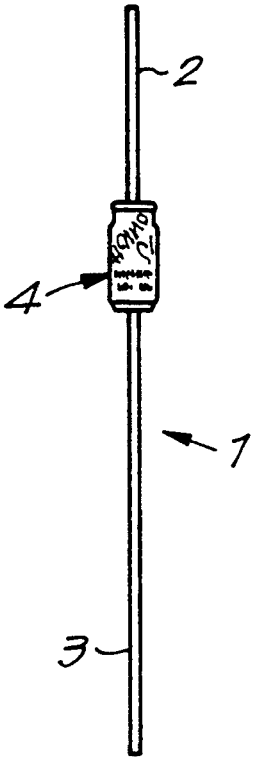
FIG. 7 represents a variant of the straw according to the invention.

In FIG. 7 a straw according to the invention is represented, whereby the enlargement 4 represents a can as is generally used for selling soft drinks and the like.

Figure 8:
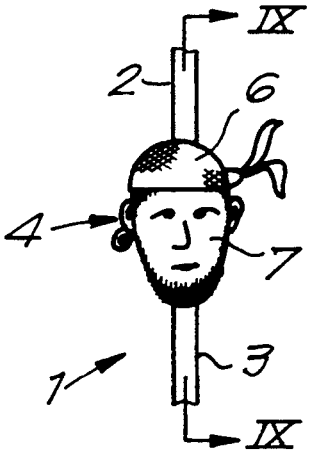
FIG. 8 represents another variant of a straw.
Figure 9:
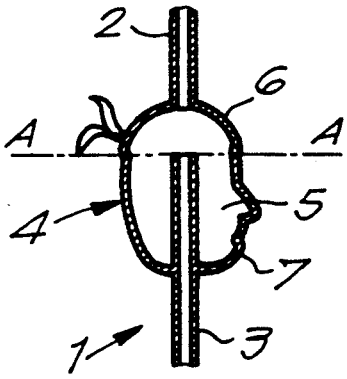
FIG. 9 represents a cross-section according to line IX—IX in FIG. 8.

In FIG. 8 a straw according to the invention is represented, whereby the enlargement 4 has the form of a figure, for example the form of a pirate's head which consists of two main parts, namely an upper part 6 which represents the pirate's hat and a lower part 7 representing his face.

In this case the above-mentioned level A—A will for example coincide with the lower edge of the hat 6 so that, after beverage has been sucked up once, the face 7 obtains the color of the concerned beverage while the hat 6 keeps the color of the straw, for example stays clear.

Figure 11:
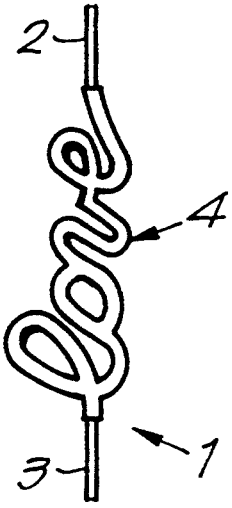
FIG. 11 represents yet another variant of a straw according to the invention.
Figure 12:
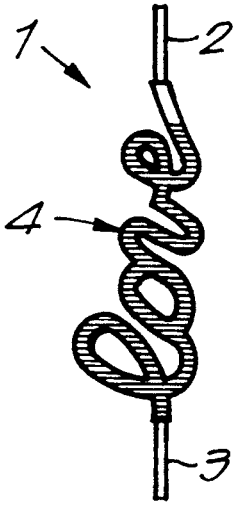
FIG. 12 represents the straw according to FIG. 11 after beverage has been sucked up.
Figure 10:
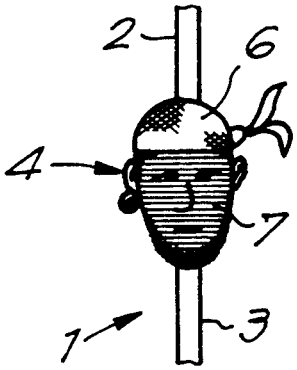
FIG. 10 represents the straw according to FIG. 8, after beverage has been sucked up.

In FIGS. 11 and 12 the enlargement 4 forms an expression or message which will stay filled after the straw 1 has been sucked on once.

It is clear that the straw according to the invention is in no way limited to the embodiments described as examples and represented in the accompanying drawings and that such straw can be realized in any form and dimension and can be provided with any enlargement in the form of any recipient, figure, message or the like, without leaving the scope of the invention.

We claim:

1. A straw comprising:

a hollow upper part including first and second ends;

a hollow lower part including first and second ends; and an enlargement positioned between said hollow upper and lower parts, said enlargement including a top, a bottom and an outer wall interconnecting said top and bottom, said top, bottom and outer wall collectively defining an enclosure, the first end of said hollow lower part extending into said enclosure through said bottom and having an uppermost portion terminating within said enclosure below said top thereby defining, within said enclosure, a space bordered by the first end of said hollow lower part, the outer wall of said enlargement and the bottom of said enlargement, the second end of said hollow upper part being attached to and opening into said enclosure above said space such that when the second end of said hollow lower part is placed in a beverage container and a suction force is applied to the first end of said hollow upper part, a beverage from the container will be drawn into the second end of said hollow lower part, fill the enclosure and flow through the hollow upper part and, when the suction force is removed, the space defined within the enclosure will retain some of the beverage.

2. A straw according to claim 1, wherein the enlargement takes the form of a bottle representing a bottle in which a beverage to be sucked up through the straw in normally marketed.

3. A straw according to claim 1, wherein the enlargement takes the form of a can representing a can in which a beverage to be sucked up through the straw is normally marketed.

4. A straw according to claim 1, wherein the enlargement takes the form of a figure.

5. A straw according to claim 1, wherein the enlargement takes the form of a message.

* * * * *